US009668598B2

(12) United States Patent
Wartersian et al.

(10) Patent No.: US 9,668,598 B2
(45) Date of Patent: Jun. 6, 2017

(54) SELF-RIGHTING HANDHELD UTENSIL

(71) Applicants: Kevork Wartersian, West Bloomfield, MI (US); Harout Wartersian, West Bloomfield, MI (US)

(72) Inventors: Kevork Wartersian, West Bloomfield, MI (US); Harout Wartersian, West Bloomfield, MI (US)

(73) Assignee: Vartian Corp., West Bloomfield, MI (US)

( * ) Notice: Subject to any disclaimer, the term of this patent is extended or adjusted under 35 U.S.C. 154(b) by 0 days.

(21) Appl. No.: 14/817,713

(22) Filed: Aug. 4, 2015

(65) Prior Publication Data

US 2016/0245456 A1 Aug. 25, 2016

Related U.S. Application Data

(63) Continuation-in-part of application No. 14/627,001, filed on Feb. 20, 2015.

(51) Int. Cl.
*E05D 13/00* (2006.01)
*A47G 21/04* (2006.01)
(Continued)

(52) U.S. Cl.
CPC ..... *A47G 21/04* (2013.01); *A46B 15/0097* (2013.01); *A47G 21/02* (2013.01); *A47G 21/023* (2013.01); *B25G 1/102* (2013.01); *B25G 3/36* (2013.01); *B43K 23/04* (2013.01); *B43L 19/0056* (2013.01); *A46B 2200/1066* (2013.01); *A47G 2400/086* (2013.01)

(58) Field of Classification Search
CPC ..... F16M 13/005; A47G 21/02; A47G 21/04; A47G 29/08; A46B 9/04; B43K 23/00
USPC ..... 248/111, 346.2, 910, 364; 401/131, 243, 401/246
See application file for complete search history.

(56) References Cited

U.S. PATENT DOCUMENTS 1,690,311 A * 11/1928 Reich ..... A47K 1/09 206/362.3
3,442,045 A * 5/1969 Green ..... A63H 15/06 446/297

(Continued)

OTHER PUBLICATIONS

A+R Store, Bobble Toothbrush Holder, http://aplusrstore.com/product.php?id=776.

(Continued)

*Primary Examiner* — Gwendolyn Baxter
(74) *Attorney, Agent, or Firm* — Jay Schloff; Aidenbaum Schloff and Bloom PLLC

(57) ABSTRACT

A self-righting handheld utensil comprises a weighted base having a generally rounded bottom end, an elongated region extending outwardly from the base, and a use portion. The base, by virtue of its generally rounded bottom and mass, provide for a self-righting function for the disclosed utensil such that, when placed on a flat or substantially flat surface, it counterbalances the utensil to an upright vertical orientation without the need for user intervention or the application of any external force. The base need not become uncoupled from the elongated region and use portion before the user makes operative use of the disclosed utensil. The bottom end of the base may comprise one of several structural embodiments that retain the self-righting function of the utensil.

12 Claims, 11 Drawing Sheets

(51) Int. Cl.

| | |
|---|---|
| ***B43L 19/00*** | (2006.01) |
| ***A46B 15/00*** | (2006.01) |
| ***B25G 1/10*** | (2006.01) |
| ***B25G 3/36*** | (2006.01) |
| ***A47G 21/02*** | (2006.01) |
| ***B43K 23/04*** | (2006.01) |

(56) References Cited

U.S. PATENT DOCUMENTS

| | | | | | |
|---|---|---|---|---|---|
| 3,712,749 | A | | 1/1973 | Roberts | |
| 3,747,887 | A | * | 7/1973 | Binkley | A47C 7/002 248/501 |
| 4,065,171 | A | * | 12/1977 | Nagy | B60J 3/02 248/364 |
| 5,454,654 | A | | 10/1995 | Bergstrom | |
| 5,457,448 | A | * | 10/1995 | Totsuka | H04N 5/64 340/12.5 |
| 5,839,712 | A | | 11/1998 | Wang | |
| 6,168,034 | B1 | | 1/2001 | Perrone | |
| 6,200,052 | B1 | | 3/2001 | Pitaniello | |
| 6,698,065 | B2 | | 3/2004 | Lauer | |
| D589,261 | S | * | 3/2009 | Nanda | D4/107 |
| 9,139,325 | B2 | * | 9/2015 | Madrid | B65D 1/0223 |
| 2003/0019078 | A1 | * | 1/2003 | Lauer | A46B 5/00 16/110.1 |
| 2006/0226324 | A1 | | 10/2006 | Pitaniello | |

OTHER PUBLICATIONS

Gustav Innovation, Slanda, http://www.gustavinnovation.se/ProductInfo.aspx?id=2.

* cited by examiner

SELF-RIGHTING HANDHELD UTENSIL

CROSS-REFERENCE TO RELATED APPLICATIONS

The present application is a continuation-in-part of and claims priority under 35 U.S.C. §120 on the pending U.S. patent application Ser. No. 14/627,001, filed on Feb. 20, 2015, the disclosure of which is incorporated by reference.

FIELD OF THE DISCLOSURE

The present disclosure relates to a handheld utensil, and more particularly, to a handheld utensil, such as a pen, capable of self-righting to a vertical orientation upon being dropped, thrown, or otherwise moved onto a flat or substantially flat surface.

BACKGROUND

Handheld utensils are used every day to make people's lives easier. Certain utensils, such as forks and spoons, assist in the delivery of food from a plate or bowl to a person's mouth. Similarly, other utensils, such as pens and pencils, allow a person to write, draw, or otherwise record anything he or she wishes on a paper or substrate. Still further utensils such as toothbrushes allow a user to easily clean his or her teeth and gums. The quality of being handheld makes a utensil easy to use, maintain, and store.

However, given that handheld utensils are generally relatively small objects, it is easy for them to become lost or misplaced, or otherwise become buried underneath larger objects. For example, a user of a pen may set down the pen upon finishing a sentence, but later, after numerous papers have been placed over the pen, when the user subsequently requires it again, he or she may be unable to locate it underneath the papers. As such, it is desirable for a handheld utensil to provide some easy means of permitting its user to locate it in a short time, and it is further desirable that such means be inexpensive and not interfere with the character or operation of the utensil.

An option for solving the aforesaid problem is by introducing a self-righting or biasing element to the handheld utensil. A first solution for providing a self-righting handheld utensil is shown in U.S. Pat. No. 6,200,052 as a balancing pen. The disclosed balancing pen includes a bulb having a center of mass therein and rounded underside for balancing the pen when not in use, which bulb separates from the pen when the user requires use thereof. That is, the user may replace the pen within the bulb when same is not in use, and the bulb maintains the pen in a generally upright orientation. Regardless, this disclosure fails to teach a self-righting handheld utensil wherein the portion providing the self-righting feature remains coupled to the utensil itself during operative use of the utensil. In other words, should the user misplace the bulb while using the disclosed writing implement, this prior art disclosure would cease to operate as intended (in that the disclosed writing implement could no longer self-right).

Thus, while existing solutions show some self-righting features, various drawbacks, including those mentioned above, remain.

Consequently, there exists a need for a handheld utensil that self-rights itself to an upright vertical orientation when placed on a flat or substantially flat surface, and which comprises a weighted element as a base for providing for the self-righting features that does not need to be uncoupled from the use portion of the utensil in order for a user to operatively use the utensil.

SUMMARY OF THE INVENTION

In view of the foregoing disadvantages of the prior art, a self-righting handheld utensil configured to include all the advantages of the prior art and to overcome the drawbacks inherent therein is provided. It is an object of the present disclosure to provide a self-righting handheld utensil that comprises a weighted element as a base having a generally convex bottom end so as to provide for an automatic balancing of the utensil to an upright vertical orientation when placed on a flat or substantially flat surface, i.e. without the need for user intervention or application of any external force. It is further an object of the present disclosure to provide a self-righting handheld utensil wherein the weighted element does not need to be uncoupled from the remainder of the utensil (i.e., the use portion thereof) in order for the user to operatively use the utensil.

In an embodiment, a self-righting handheld utensil comprises a base having a top end and a bottom end; a weighted element disposed within the base; a an elongated region extending outwardly from the base, the elongated region having a first end and a second end, the first end being in communication with the top end of the base, the elongated region capable of being held by a user; and a use portion disposed on the second end of the elongated region, wherein the weighted element is capable of counterbalancing the utensil to an upright vertical orientation with respect to a flat or substantially flat surface supporting the utensil without the need for user intervention or an application of an external force, resulting in the elongated region and the use portion becoming oriented vertically with respect to the flat or substantially flat surface supporting the utensil, and wherein the utensil may be used without the base first having to be separated from the elongated region or the use portion, and wherein the bottom end of the base comprises one of a flat region, a plurality of spike elements having generally flat ends, and a plurality of spike elements having generally rounded ends.

Further alternatives and embodiments are herein contemplated. In a further embodiment, the first end of the elongated region is in communication with the weighted element. In another embodiment, the top end of the weighted element comprises one of a flat surface, a generally concave surface, and a generally convex surface. In another embodiment, the weighted element comprises at least one of a metal, metal alloy, sand, rubber, plastic, liquid, stone, silicone, oil, wood, gel, soil, and a processed material comprising one or more of the foregoing. In another embodiment, the utensil is one of a pen, pencil, marker, crayon, eraser, highlighter, toothbrush, fork, and spoon, as shown in FIGS. 1A-1G. In another embodiment, the utensil further comprises an internal element disposed within at least a portion of the elongated region and the use portion, the internal element containing a chamber suitable for containing at least one of ink, lead, graphite, and wax. In another embodiment, the elongated region and use portion are removably attached to the weighted element via a coupling, such as a threading, snap-fit engagement, and mechanical interference.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

Figure 1:
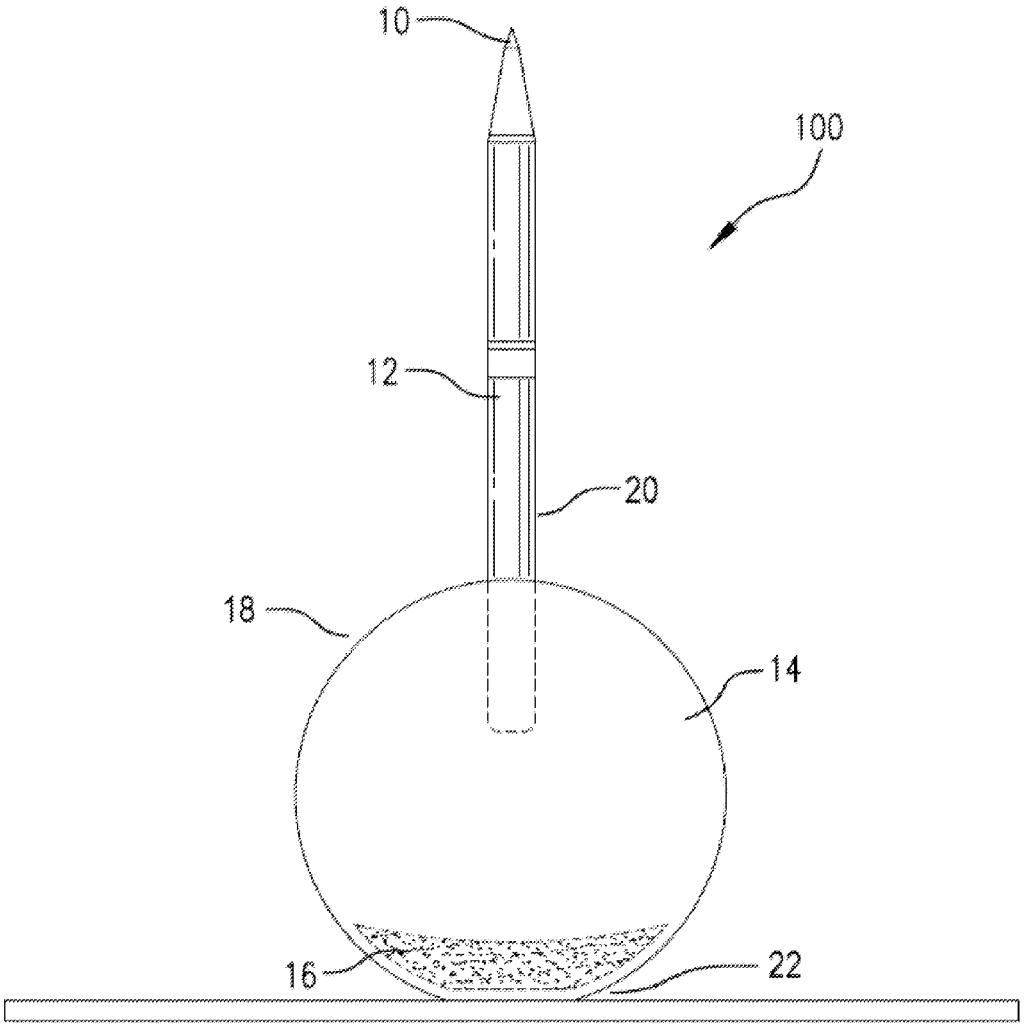
FIG. 1 shows an exemplary depiction of the disclosed self-righting handheld utensil in accordance with an exemplary embodiment of the present disclosure comprising a flat region on the bottom end of the base.
Figure 1A:
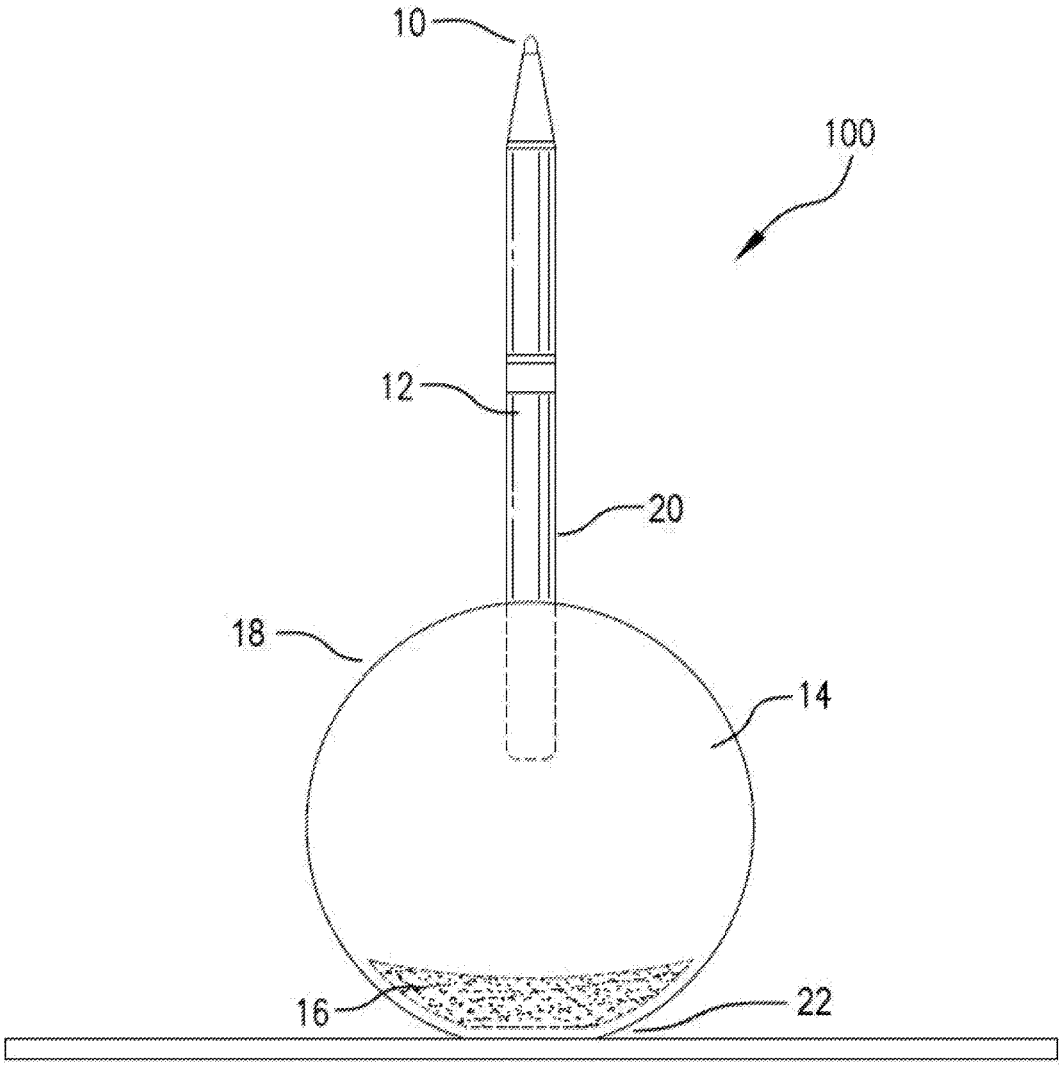
FIGS. 1A-1G show an exemplary depiction of the disclosed self-righting utensil in accordance with an exemplary embodiment of the present disclosure.
Figure 1B:
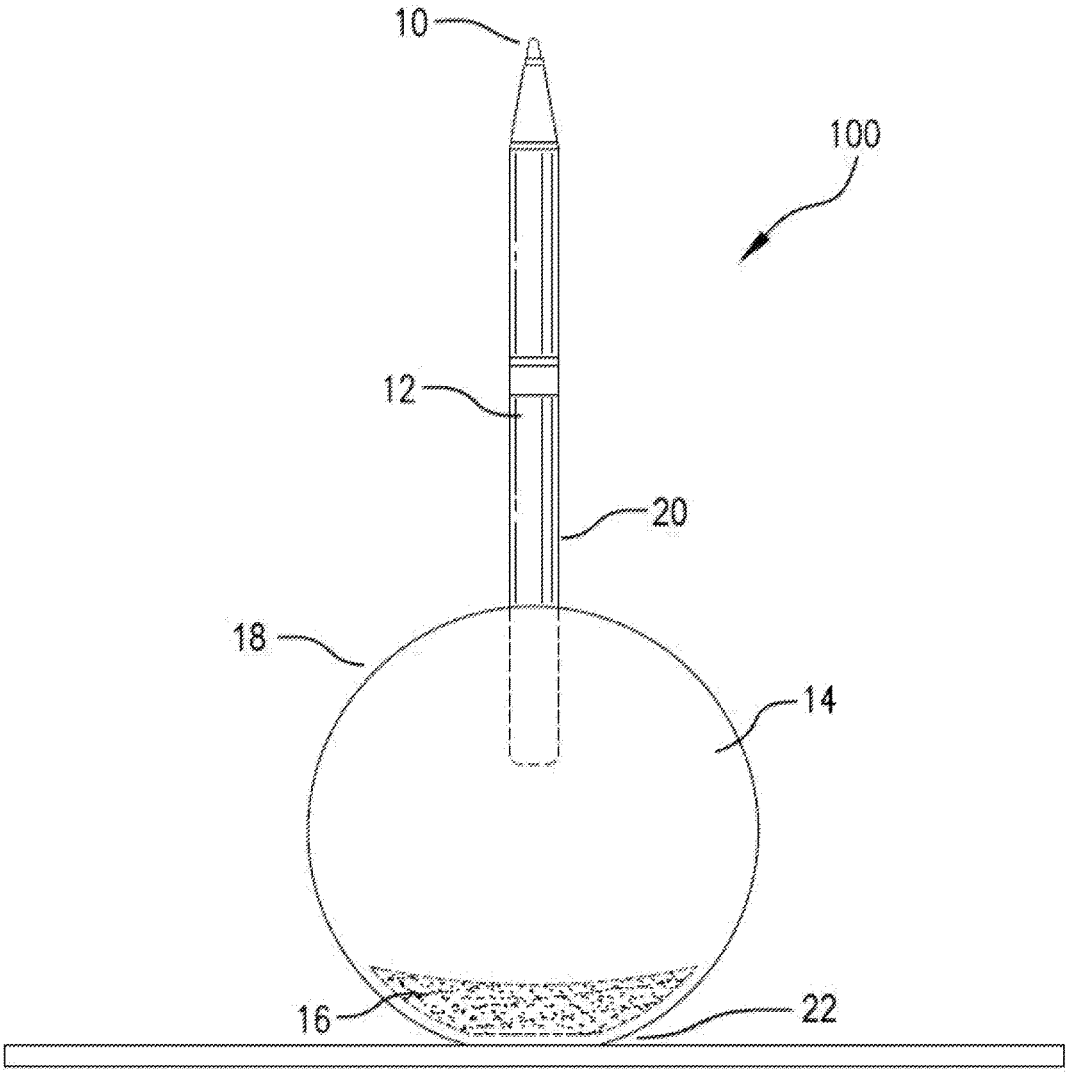
Figure 1C:
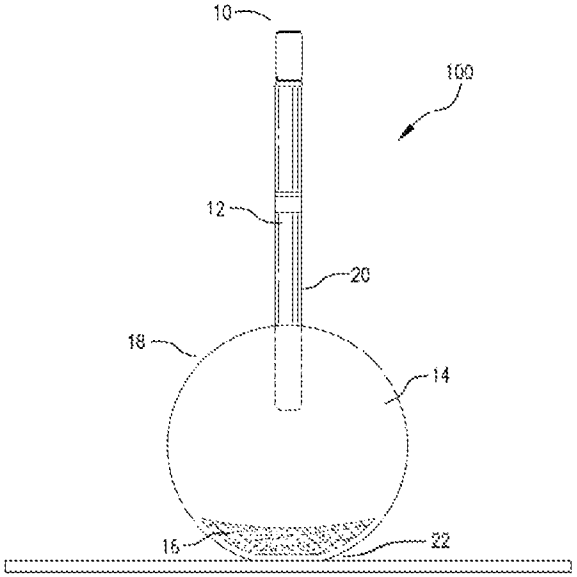
Figure 1D:
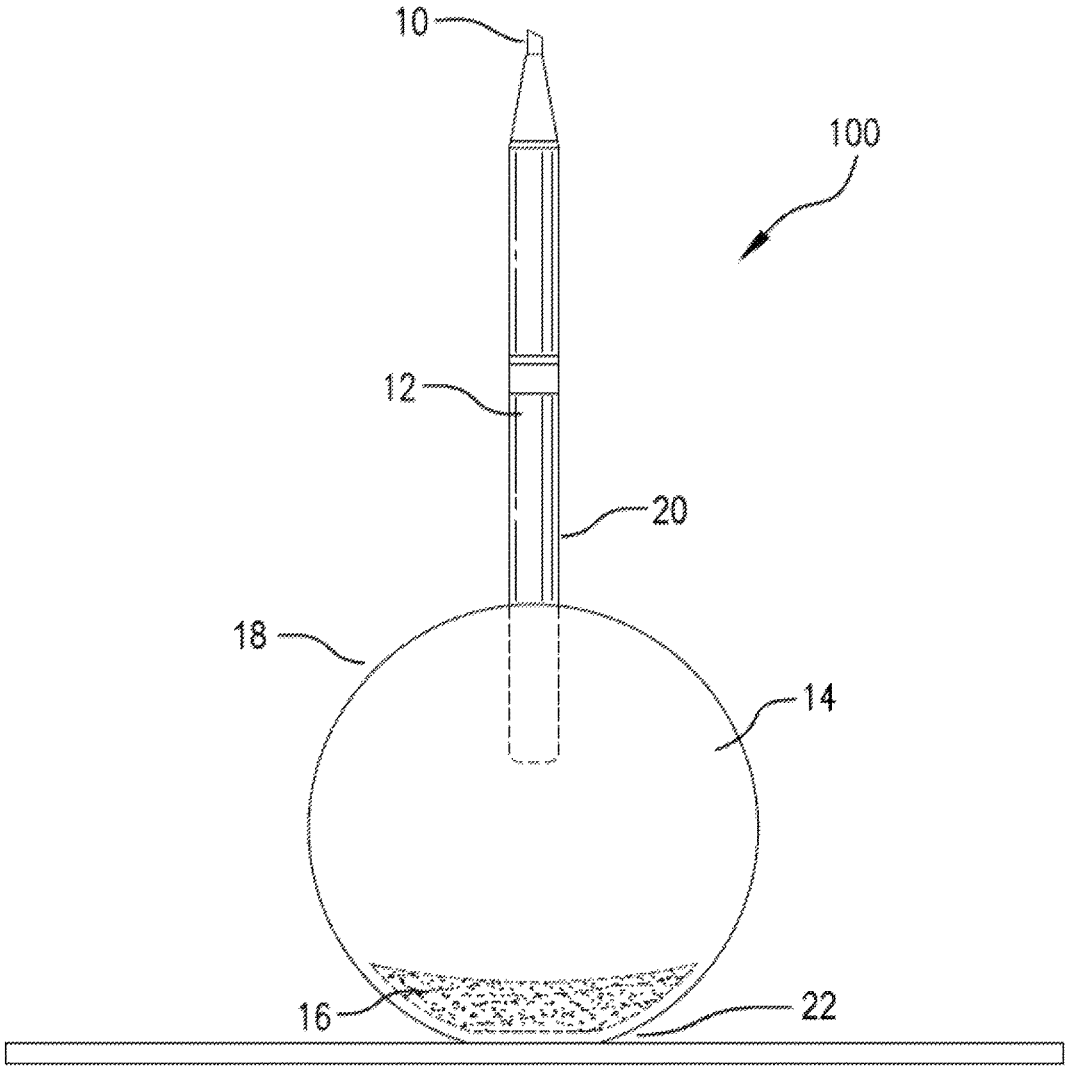
Figure 1E:
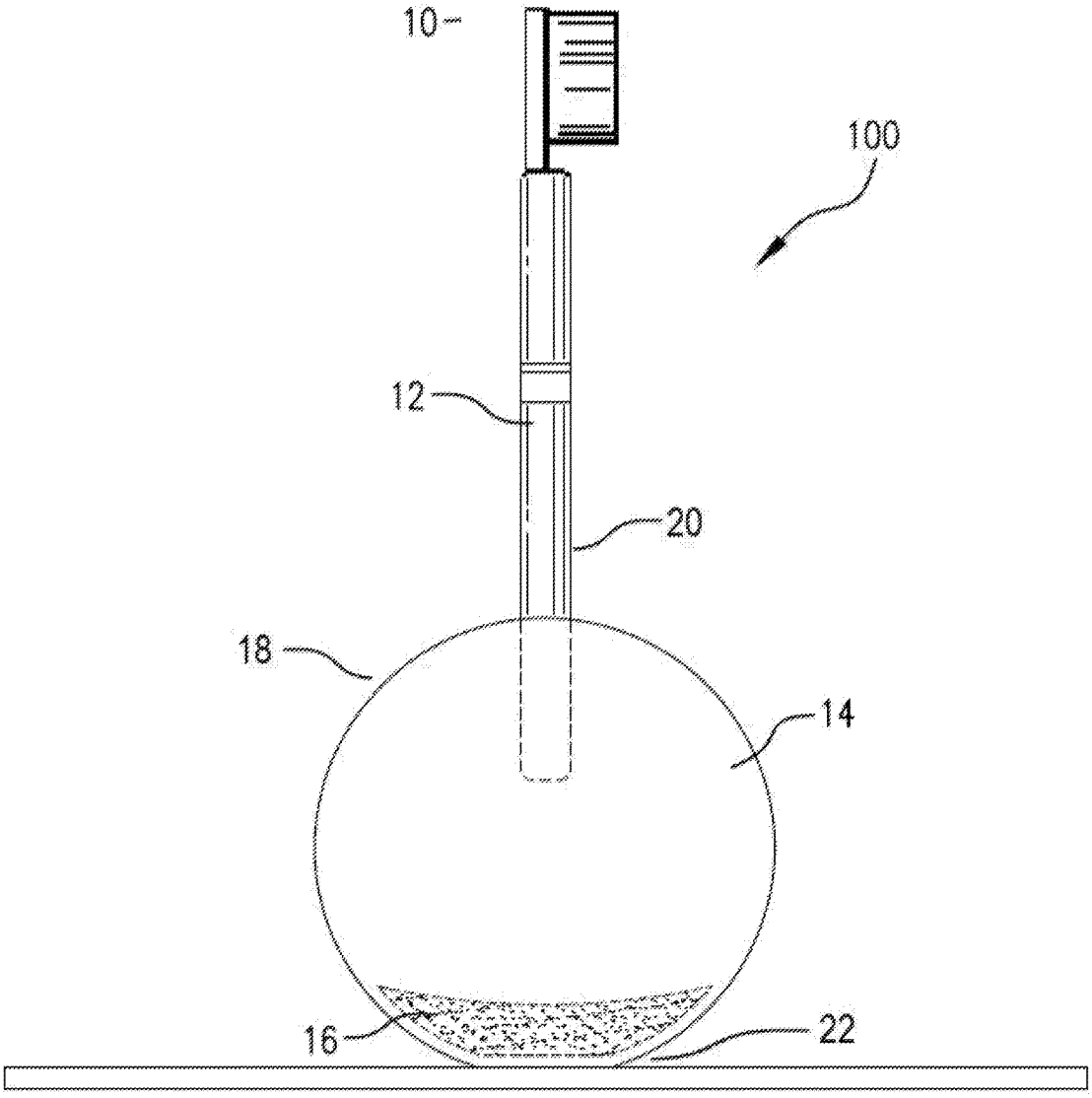
Figure 1F:
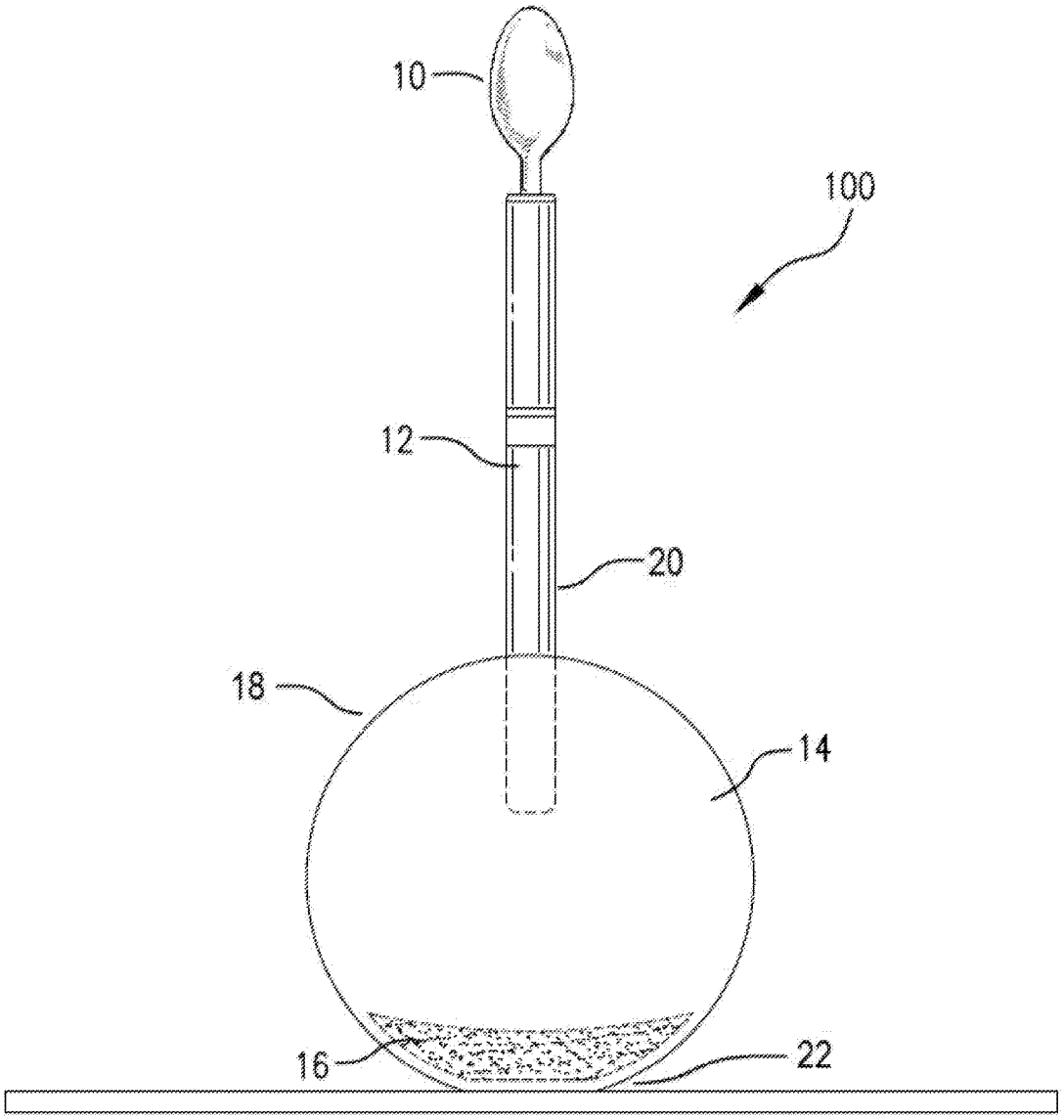
Figure 1G:
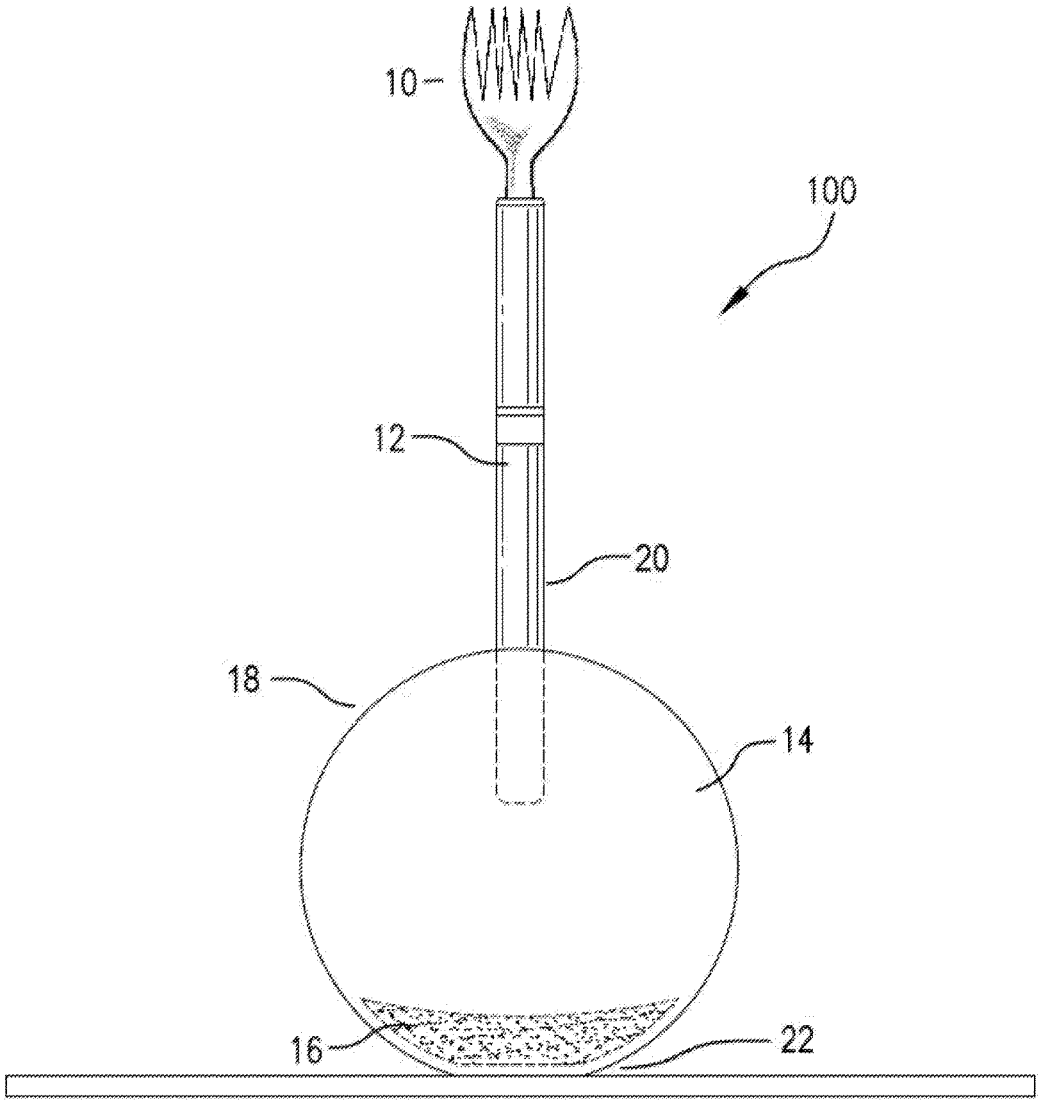

The best mode for carrying out the present disclosure is presented in terms of its preferred embodiments, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure.

The terms "a" and "an" herein do not denote a limitation of quantity, but rather denote the presence of at least one of the referenced items.

The present disclosure comprises a handheld utensil capable of self-righting itself to a vertical orientation upon being dropped, thrown, or otherwise moved. The utensil comprises a base, a weighted element disposed within the base, an elongated region extending outwardly from the base, and a use portion disposed on an end of the elongated region distal from the base. The base may be of any geometric shape provided that it is generally rounded on a bottom end in order to provide for the vertical self-righting function herein described.

The elongated region is capable of being held by a user and may itself comprise a handle or otherwise graspable portion of the embodied utensil. The use portion comprises the specific part of the utensil operated by or for the user, such as the portion of a pen from which ink is drawn, the spokes of a fork that retain collected food, or the bristles of a toothbrush that make contact with and clean a user's teeth and gums. The elongated region may further include an internal element disposed therein, for example, as an ink cartridge. In an embodiment, the internal element is removably disposed within the elongated region. In a further embodiment, the elongated region and use portion of the utensil are removably attached to the base. Notwithstanding the particular embodiment of the present disclosure, it will be apparent that the elongated region and use portion in combination must comprise a lesser mass than that of the base, including the weighted element, in order for the disclosed self-righting effect of the weighted element to occur.

At any time when the user has finished using the disclosed utensil, he or she may simply toss, throw, drop, or otherwise move it away from his or her person without having to place the utensil in a particular rest position. That is, upon being so displaced on a flat or substantially flat surface, and regardless of the utensil's orientation at the time the user displaces same, the base, by virtue of its rounded features and mass, directs the utensil into an upright vertical orientation without the need for user intervention or application of any external force. By way of further benefit, the present disclosure teaches allowing a user to operate the disclosed utensil without having to first remove the base (i.e., that the base may remain attached while the utensil is in operative use), which prevents the user from misplacing or losing the base while separated from the remainder of the utensil. The present disclosure may conceivably pertain to any relatively lightweight, handheld utensil, most notably a pen, a similar writing tool, or a toothbrush, noting that the embodiments discussed herein are intended to be non-exhaustive.

Referring now to FIG. 1, and in an embodiment, a self-righting handheld utensil is shown at 100 as relating to a pen. The use portion 10 of the utensil (e.g., the end of the pen from which ink is drawn) is shown at a terminal end of the utensil 100 so as to permit for the unobstructed use of the utensil 100 as desired by the user. An elongated region 12 extends laterally from the use portion 10 relative to the remainder of the utensil 100, which elongated region 12 is capable of being held by a user in one or more portions thereof.

A base 14 comprising a weighted element 16 is disposed at an end of the utensil 100 distal from the use portion 10 thereof. A top end 18 of the base 14 is in communication with at least a portion of a first end 20 of the elongated region 12. Although the figure depicts the first end 20 as being received within a portion of the top end 18 of the base 14, it is contemplated and understood that communication between the first end 20 of the elongated region 12 and the top end 18 of the base 14 may be defined as the mere contacting of those components or instead as an intersection thereof (e.g., wherein one such component is partially received by the other, such as is shown in the figure).

It will be apparent that, in order for the disclosed counterbalancing function to operate as intended, the weighted element 16 must be of a mass greater than that of the combined mass of the elongated region 12 and use portion 10 of the utensil 100. Notwithstanding that the figure depicts the weighted element 16 as comprising plastic or a processed material comprising plastic, it is understood and contemplated that the weighted element 16 may comprise a metal, metal alloy, sand, rubber, plastic, liquid, stone, silicone, oil, wood, gel, soil, a processed material comprising one or more of the foregoing, or any other combination thereof.

The base 14 may comprise any geometric shape provided that the bottom end 22 thereof is generally. That is, and as will be discussed below, it will be apparent that, in order to operate as intended, the base 14 must have a generally rounded bottom end 22, provided, however, that the specific structure of the bottom end 22 need not be completely or continuously rounded to account for the disclosed self-righting function of the utensil 100. Thus, it is understood that the base 14 may in fact comprise any suitable geometry wherein the bottom end 20 thereof is generally rounded, provided that the mass of the elongated region 12 (including the use portion 10 of the utensil 100) remains less than that of the weighted element 16. Separately, the top end 18 of the base 14 is not limited to a particular geometry and may comprise, for example, any of a flat surface, a generally concave surface, and a generally convex surface.

Additional exemplary embodiments of the utensil 100 are herein disclosed to illustrate the various structures capable of comprising the base 14. In a first such embodiment, as shown in FIG. 1, the bottom end 22 of the base 14 comprises a generally convex, rounded shape, except that a flat region 24 is located at the terminal point thereof. It will be apparent that the presence of the flat region 24 to flatten or limit the roundedness of the bottom end 22 of the base 14 does not detrimentally affect the self-righting function of the utensil 100, but rather may support more stable retention of the utensil 100 in said upright position once the self-righting function has completed. That is, by presenting a flat region 24 on the terminal portion of the bottom end 22 of the base 14, the surface area of the portion of the base in contact with the generally flat surface upon which the utensil 100 comes to rest may be maximized, which minimizes any undesirable rocking or teetering movement of the utensil 100 subsequent to the performance of the self-righting function.

Figure 2A:
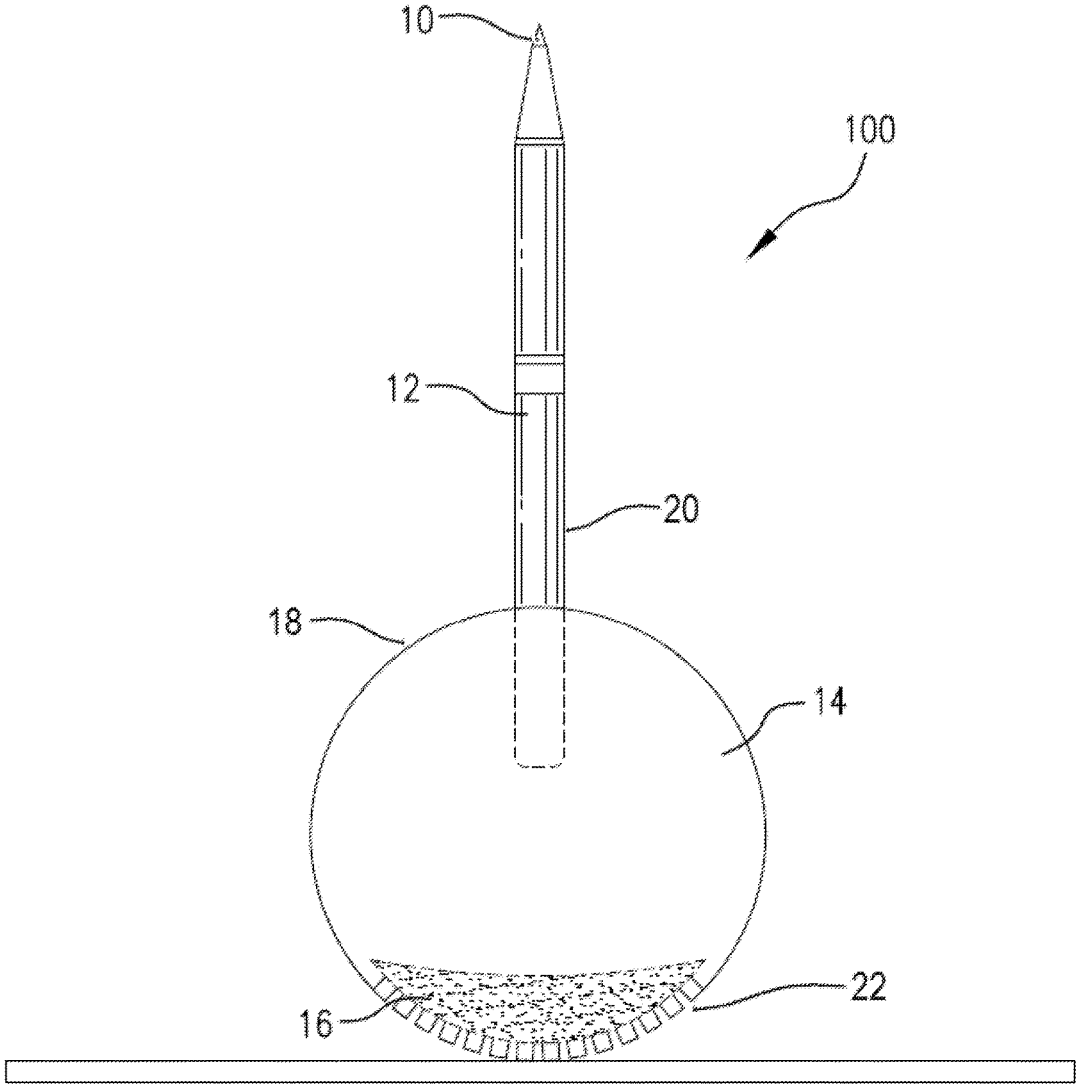
FIG. 2A shows an exemplary depiction of the disclosed self-righting handheld utensil in accordance with an exemplary embodiment of the present disclosure comprising a plurality of spike elements having generally flat ends.
Figure 2B:
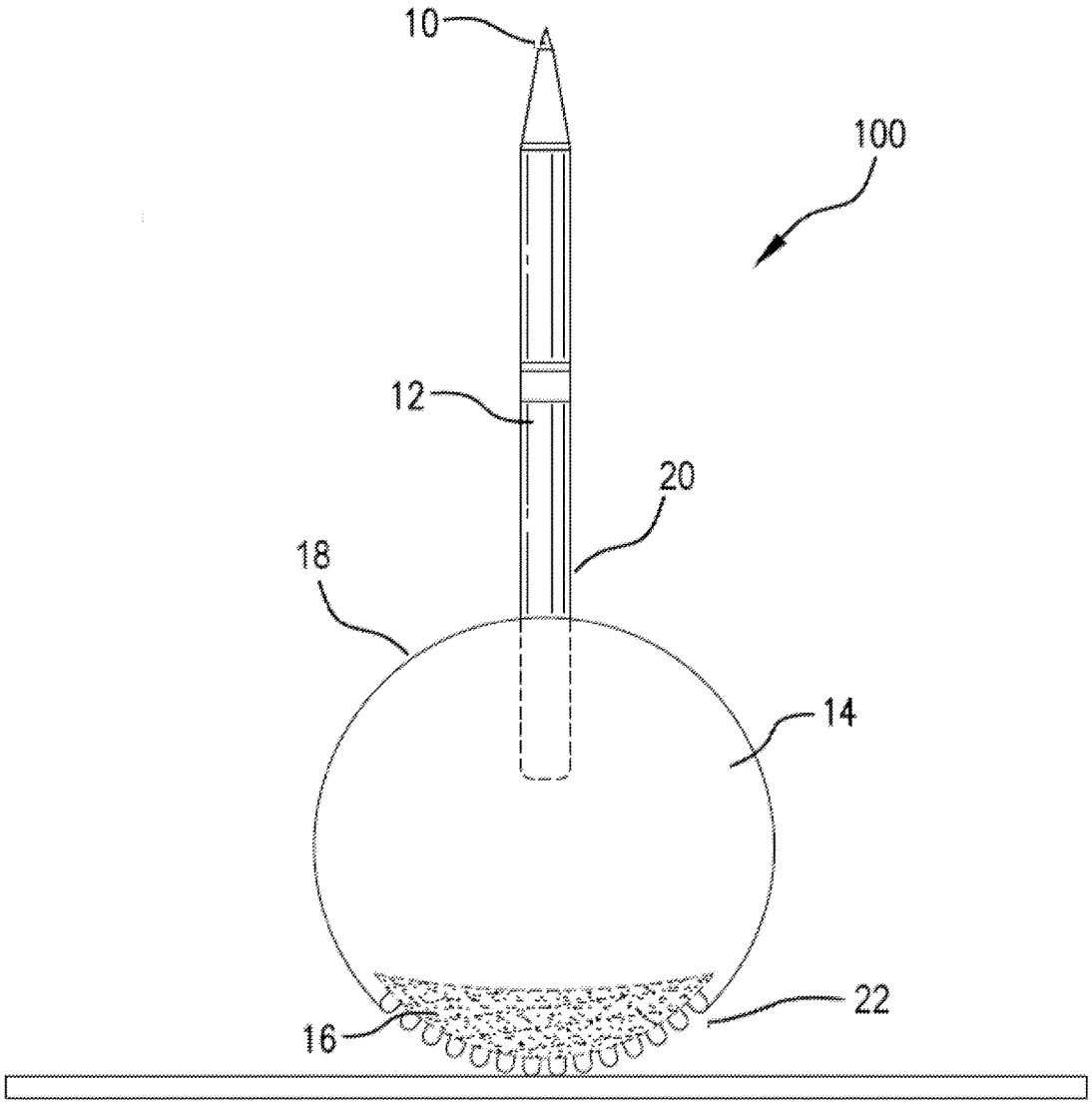
FIG. 2B shows an exemplary depiction of the disclosed self-righting handheld utensil in accordance with an exemplary embodiment of the present disclosure comprising a plurality of spike elements having generally rounded ends.

In a further exemplary embodiment, and as shown in FIG. 2A, the bottom side 22 of the base 14 may alternatively comprise a plurality of individual spike elements 26 that are generally formed in a spherical arrangement in order to provide for the self-righting function of the utensil 100. The spike elements 26 are separated (i.e., they do not form a continuous structure), and it will be apparent that the degree to which same are spaced does not matter so long as the self-righting function of the utensil 100 remains satisfactory. While the spike elements 26 of FIG. 2A are generally flat on the bottom ends thereof, FIG. 2B depicts another exemplary embodiment wherein the spike elements 26 are generally rounded.

Figure 3:
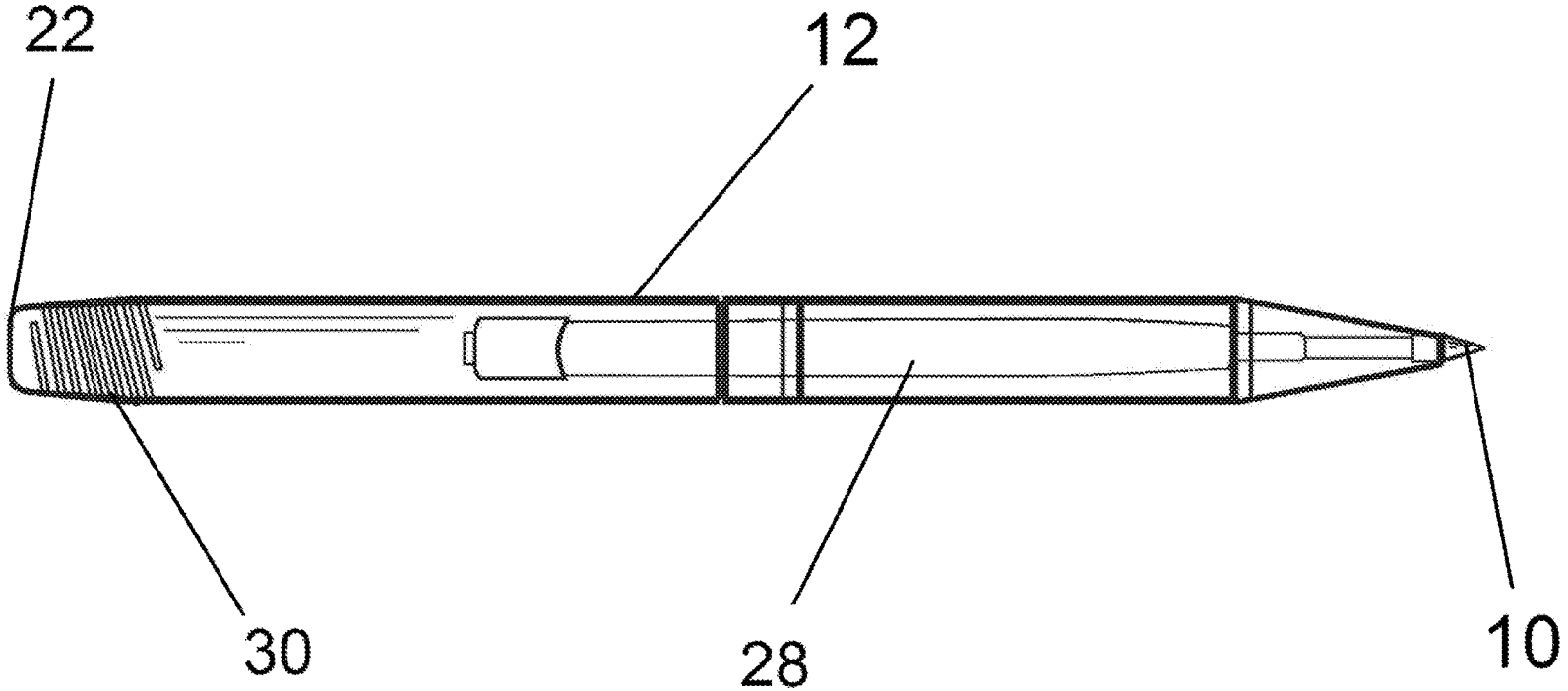
FIG. 3 shows an exemplary depiction of the elongated region and use portion of the disclosed self-righting handheld utensil separated from the base thereof in accordance with an exemplary embodiment of the present disclosure.

As shown in FIG. 3, it will be apparent that the elongated region 12 may further include an internal element 28 disposed therein, which internal element 28 may be necessary for the operation, or beneficial for the optimal operation, of the utensil 100. For example, wherein the utensil 100 is a pen, the internal element 28 may comprise an ink cartridge. In an embodiment wherein the elongated region 12 comprises an internal element 28, the internal element 28 is removably disposed within the elongated region 12. For example, the user may wish to replace the internal element 28 wherein it comprises an ink cartridge that has emptied. In a further such embodiment, the internal element 28 is inseparable from the elongated region 12.

The utensil 100 may further include a coupling 30 at or near the first end 20 of the elongated region 12 that removably secures the utensil 100 to the base 14, for example, for use in the event the utensil 100 becomes damaged and requires replacement. The coupling 30 may be any structural mechanism for removably engaging the utensil 100 and base 14; however, preferably, the coupling 30 will be one of a threading, snap-fit engagement, or mechanical interference. Notwithstanding the foregoing, it will be apparent that any structure may be utilized provided that the coupling 30 operates in accordance with this disclosure.

In use, the user may operate the utensil 100 as desired without first having to separate any components thereof, such as by uncoupling the base 14 with the elongated region 12 and use portion 10. In this way, the risk of misplacing any separated components is eliminated. Once the user has finished using the utensil 100, he or she may toss, throw, drop, or otherwise move it away from his or her person without having to place it in a particular rest position. The disclosed utensil 100, upon being so displaced on a flat or substantially flat surface, will be directed to an upright vertical orientation wherein, as a result of the self-righting mechanism, the use portion 10 becomes pointed upwardly relative to said flat surface, which makes the utensil 100 more readily available and identifiable to the user for future use. Various structural embodiments for the base 14 may be used so long as each retains the self-righting aspect of the utensil 100. In that the use portion 10 of the utensil 100 may be used without first having to separate the elongate region 12 or any other portion of the utensil 100 from the base 14, the risk of the user losing or misplacing the base 14 while the utensil 100 is in operative use is entirely eliminated.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A self-righting handheld utensil comprising:

a base having a top side and a bottom side;

a weighted element disposed within at least a portion of said base;

an elongated region extending outwardly from said base, said elongated region having a first end and a second end, at least a portion of said first end of said elongated region being disposed within at least a portion of said base, said elongated region capable of being held by a user;

a use portion disposed on said second end of said elongated region; and an internal element disposed within at least a portion of said elongated region and said use portion, said internal element containing a chamber, wherein said weighted element is capable of counterbalancing said utensil to an upright vertical orientation with respect to a flat or substantially flat surface supporting the utensil without the need for user intervention or an application of an external force, resulting in said elongated region and said use portion becoming oriented vertically with respect to the flat or substantially flat surface supporting the utensil, and wherein the utensil may be used without said base first having to be separated from said elongated region or said use portion, and wherein said bottom side of said base comprises one of a flat region, a plurality of spike elements having generally flat ends, and a plurality of spike elements having generally rounded ends.

2. The utensil of claim 1, wherein said first end of said elongated region is in communication with said weighted element.

3. The utensil of claim 1, wherein said top end of said weighted element comprises one of a flat surface, a generally concave surface, and a generally convex surface.

4. The utensil of claim 1, wherein said weighted element comprises at least one of a metal, metal alloy, sand, rubber, plastic, liquid, stone, silicone, oil, wood, gel, soil, and a processed material comprising one or more of the foregoing.

5. The utensil of claim 1, wherein said utensil is one of a pen, pencil, marker, crayon, eraser, highlighter, toothbrush, fork, and spoon.

6. The utensil of claim 1, wherein said chamber is suitable for containing at least one of ink, lead, graphite, and wax.

7. A self-righting handheld utensil comprising:

a base having a top side and a bottom side;

a weighted element disposed within at least a portion of said base;

an elongated region extending outwardly from said base, said elongated region having a first end and a second end, at least a portion of said first end of said elongated region being disposed within at least a portion of said base, said elongated region capable of being held by a user;

a use portion disposed on said second end of said elongated region; and a coupling removably engaging said top end of said base and said first end of said elongated region, wherein said weighted element is capable of counterbalancing said utensil to an upright vertical orientation with respect to a flat or substantially flat surface supporting the utensil without the need for user intervention or an application of an external force, resulting in said elongated region and said use portion becoming oriented vertically with respect to the flat or substantially flat surface supporting the utensil, and wherein the utensil may be used without said base first having to be separated from said elongated region or said use portion, and wherein said elongated region and said use portion are removably attached to said base, and wherein said bottom side of said base comprises one of a flat region, a plurality of spike elements having generally flat ends, and a plurality of spike elements having generally rounded ends.

8. The utensil of claim 7, wherein said first end of said elongated region is in communication with said weighted element.

9. The utensil of claim 7, wherein said weighted element comprises at least one of a metal, metal alloy, sand, rubber, plastic, liquid, stone, silicone, oil, wood, gel, soil, and a processed material comprising one or more of the foregoing.

10. The utensil of claim 7, wherein said utensil is one of a pen, pencil, marker, crayon, eraser, highlighter, toothbrush, fork, and spoon.

11. The utensil of claim 7, wherein said utensil further comprises a chamber suitable for holding at least one of ink, lead, graphite, and wax.

12. The utensil of claim 7, wherein said coupling comprises one of a threading, snap-fit engagement, and mechanical interference.

* * * * *